US007454873B2

(12) United States Patent
McClintick

(10) Patent No.: US 7,454,873 B2
(45) **Date of Patent: *Nov. 25, 2008**

(54) ROOF SYSTEM AND METHOD FOR INSTALLATION

(75) Inventor: Edward Lee McClintick, San Antonio, TX (US)

(73) Assignee: Elk Premium Building Products, Inc., Dallas, TX (US)

( * ) Notice: Subject to any disclaimer, the term of this patent is extended or adjusted under 35 U.S.C. 154(b) by 2 days.

This patent is subject to a terminal disclaimer.

(21) Appl. No.: 11/611,085

(22) Filed: Dec. 14, 2006

(65) Prior Publication Data

US 2007/0094976 A1 May 3, 2007

Related U.S. Application Data

(63) Continuation of application No. 11/224,537, filed on Sep. 12, 2005.

(60) Provisional application No. 60/609,391, filed on Sep. 13, 2004.

(51) Int. Cl.
*E04D 1/34* (2006.01)
*E04B 1/00* (2006.01)

(52) U.S. Cl. ..... 52/551; 52/748.1

(58) Field of Classification Search ..... 52/543, 52/547, 548, 549, 550, 551, 506.05, 506.01, 52/747.11, 747.1, 748.1; 211/26.2, 45, 89.01, 211/106.01; 248/339

See application file for complete search history.

(56) References Cited

U.S. PATENT DOCUMENTS 1,358,863 A 11/1920 McConnell
1,447,290 A 3/1923 Fischer
2,097,845 A 11/1937 Snow
2,114,362 A 4/1938 Tashjian
2,205,307 A 6/1940 Parsons
RE24,246 E 12/1956 Fink et al.
3,252,257 A 5/1966 Price et al.
3,292,334 A 12/1966 Craig
3,624,975 A 12/1971 Morgan et al.
3,746,378 A 7/1973 Meyer
3,803,792 A 4/1974 Fulton
3,885,075 A 5/1975 Ferrante (Continued)

FOREIGN PATENT DOCUMENTS

GB 283027 1/1928

(Continued)

*Primary Examiner*—Brian Glessner
*Assistant Examiner*—Adriana Figueroa
(74) *Attorney, Agent, or Firm*—Baker & McKenzie LLP

(57) ABSTRACT

A roof having slate attached by battens and hangers. The hangers have a short member and a long member. The long member has a hook on one end and the remaining end is adjacent to a first outward extending arm. The first outward extending arm is adjacent to a central connecting member. The central connecting member is adjacent a second outward extending arm. The second outward extending arm is adjacent to the short member. The first and second outward extending arms are removably secured to the battens. The slate roof is installed by positioning and attaching the battens to a roof deck. The hangers are then secured to the battens by squeezing the short member and long member together and inserting the first and second outward extending arms into the adjacent hanger holders on the batten.

17 Claims, 12 Drawing Sheets

U.S. PATENT DOCUMENTS

| | | | | | |
|---|---|---|---|---|---|
| 3,894,376 | A | | 7/1975 | Shearer | |
| 4,078,349 | A | | 3/1978 | Gantner | |
| 4,610,902 | A | | 9/1986 | Eastman et al. | |
| 4,671,036 | A | | 6/1987 | Sullivan | |
| 4,680,909 | A | | 7/1987 | Stewart | |
| 4,694,716 | A | | 9/1987 | Sakamoto | |
| 5,086,552 | A | | 2/1992 | Moore | |
| 5,228,264 | A | | 7/1993 | Whitman | |
| 5,258,222 | A | | 11/1993 | Crivelli | |
| 5,457,924 | A | | 10/1995 | Fujii et al. | |
| 5,527,409 | A | | 6/1996 | Lanphier | |
| 5,531,334 | A | * | 7/1996 | Forby | 211/119 |
| 5,570,553 | A | | 11/1996 | Balkins | |
| 5,577,360 | A | * | 11/1996 | Gibbs | 52/518 |
| 5,615,523 | A | | 4/1997 | Wells et al. | |
| 5,642,596 | A | | 7/1997 | Waddington | |
| 5,791,112 | A | | 8/1998 | Plum | |
| 5,921,045 | A | * | 7/1999 | Hickey et al. | 52/543 |
| 6,052,961 | A | * | 4/2000 | Gibbs | 52/518 |
| 6,148,578 | A | | 11/2000 | Nowacek et al. | |
| 6,237,288 | B1 | | 5/2001 | Jenkins et al. | |
| 6,516,572 | B1 | | 2/2003 | Nowacek et al. | |
| 6,586,353 | B1 | | 7/2003 | Kiik et al. | |
| 6,619,006 | B1 | | 9/2003 | Shirota | |
| 6,673,432 | B2 | | 1/2004 | Kiik et al. | |
| 6,708,456 | B2 | | 3/2004 | Kiik et al. | |
| 6,990,779 | B2 | | 1/2006 | Kiik et al. | |
| 2004/0148898 | A1 | | 8/2004 | Hick | |
| 2004/0244156 | A1 | | 12/2004 | Jackson, Jr. et al. | |
| 2006/0096218 | A1 | | 5/2006 | Johnson | |

FOREIGN PATENT DOCUMENTS

| | | |
|---|---|---|
| GB | 392118 | 5/1933 |
| GB | 640776 | 7/1950 |
| GB | 1438485 | 6/1976 |
| GB | 2131060 | 6/1984 |
| JP | 2204556 | 8/1990 |
| JP | 6322898 | 11/1994 |

* cited by examiner

ROOF SYSTEM AND METHOD FOR INSTALLATION

CROSS-REFERENCE TO RELATED APPLICATIONS

This application is a continuation of U.S. application Ser. No. 11/224,537, filed Sep. 12, 2005, which claims priority to U.S. Provisional Application Serial No. 60/609,391 filed Sep. 13, 2004. U.S. application Ser. No. 11/224,537 and U.S. Provisional Application Serial No. 60/609,391 are incorporated herein by reference in their entirety for all purposes.

BACKGROUND OF THE INVENTION

1. Field of the Invention

Applicant's invention relates to a slate roof and method for installation.

2. Background Information

Slate is one of the finest roofing materials available and has several advantages over asphalt shingle roofs. State roofing is fireproof, resists hail damage, and often has a service life of 100 years or more. However, slate is a rigid natural stone product which unfortunately can be damaged by stress. Stress can be introduced into slate in several ways, but the most common cause of stress to slate is nails used to attach the slate to the roof deck. With nail installation, the nails need to be fastened so the state hangs on the nail. If the nail is inserted too tightly, the nail will pinch the slate. On the other hand if the nail is not inserted deep enough, the overlapping piece of slate may crack from the hidden pressure point. Environmental effects on the wood decking and nails may also contribute to the stress. Environmental changes such as swings in temperature and humidity can cause the decking to expand and contract. If the nails are in a bind in this situation, the slate can crack or fall.

The objective of the present invention was to design a slate roof installation system and method for installation that does not use nails to mount the slate on the roof. Some attempts in the prior art to solve this problem have used individual Z hangers which makes installation tedious. The present invention allows a plurality of hangers to be installed at one time. Since damage can also be caused during roof construction, the installation of a plurality of hangers at one time allows the slate to be installed from the top down. In addition, the nature of the hangers allows the roof to be easily repaired without tools. The metal used in the hangers can also be more durable since the present hangers do not need to be formed into a Z pattern. The hangers of the present invention are also spring tempered which helps them spring against the roof deck. This also permits the hangers to provide superior wind uplift protection.

While this application makes specific reference to slate and slate installation, the invention and techniques provided herein apply to tile and tile installation as well.

SUMMARY OF THE INVENTION

The preferred embodiment of the present invention includes a roof having state attached by battens and hangers. The hangers have a short member and a long member. The long member has a hook on one end and the remaining end is adjacent to a first outward extending arm. The first outward extending arm is adjacent to a central connecting member. The central connecting member is adjacent a second outward extending arm. The second outward extending arm is adjacent to the short member. The first and second outward extending arms are removably secured to the battens. The roof further includes state liner positioned above the hangers as well as underlayment positioned below the battens. Self-adhering membrane is placed below the underlayment. In addition, the roof includes valley metal, gable/rake edge metal and drip edge metal positioned on the roof deck. The slate roof is installed by positioning and attaching the battens to a roof deck. The hangers are then secured to the battens by squeezing the short member and long member together and inserting the first and second outward extending arms into adjacent hanger holders on the batten. The state liner is positioned above the hangers before placing down the slate. In addition, underlayment is placed below the battens and self-adhering membrane is placed below the underlayment.

DETAILED DESCRIPTION OF THE PREFERRED EMBODIMENT

Figure 1:
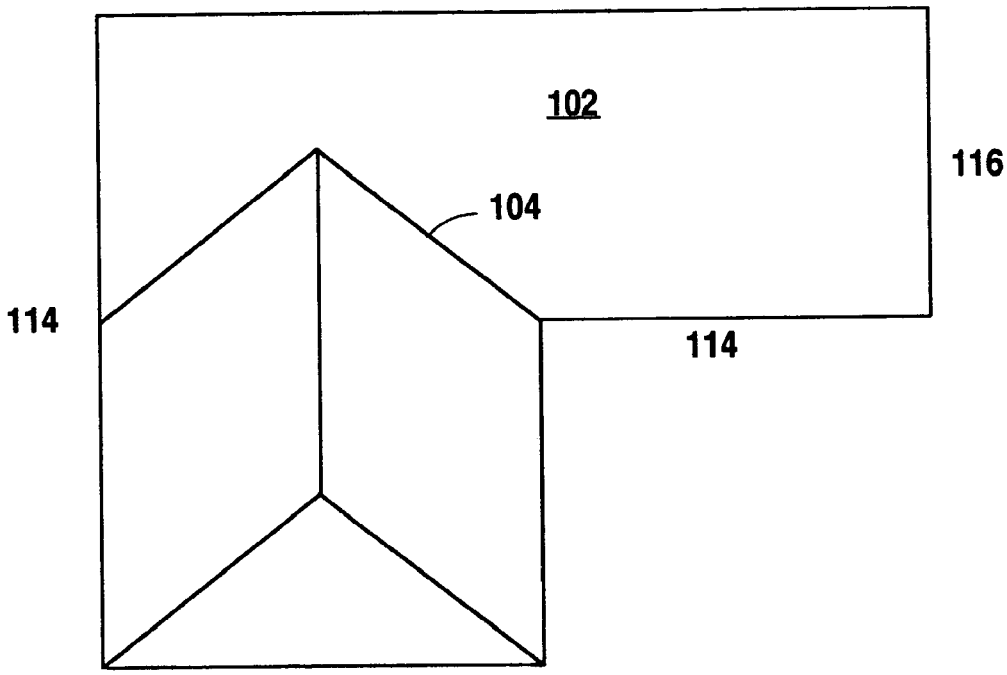
FIG. 1 is a top view of a roof deck.

In FIG. 1 a top view of a roof deck 102 is shown. In the present methodology, the initial step is to inspect and prepare the roof deck 102. The roof deck 102 has a valley 104, eave 114, gable/rake 116 and ridge 118. In this roof deck 102 inspection step, the existing roof sheathing is inspected for structural integrity. The roof deck 102 should be preferably minimum 15/32 inch plywood or code approved oriented strand board (OSB). All roof deck 102 nails should be driven flush with the roof deck 102. The roof deck 102 should be inspected for protrusions which may damage felt underlayment 110 (See FIG. 3).

Figure 2:
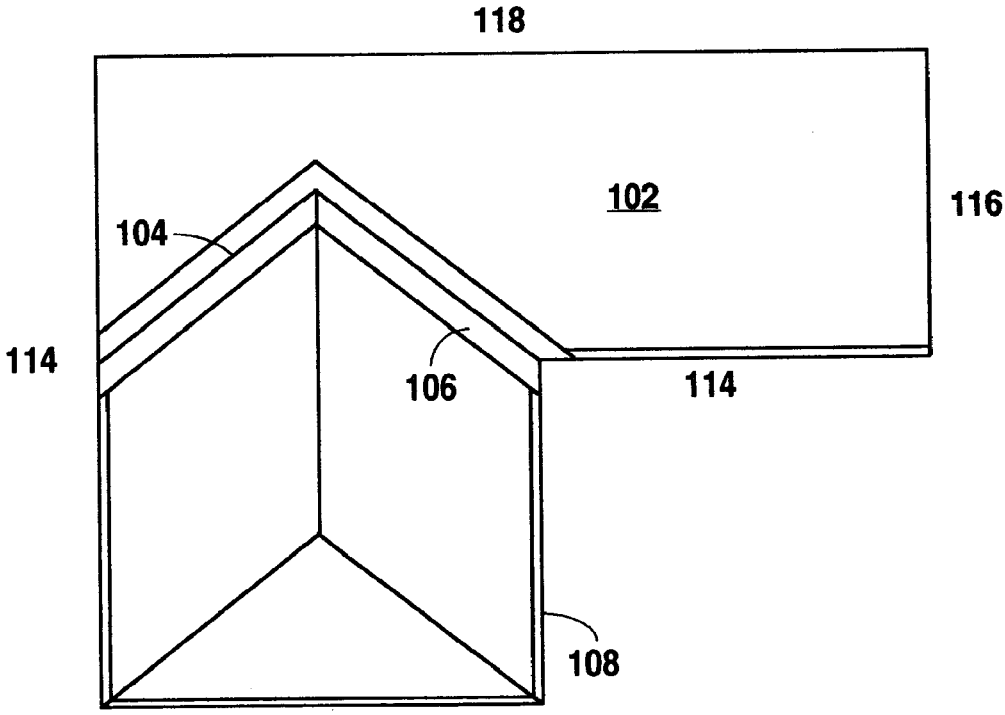
FIG. 2 is a top view of the roof deck illustrating valley preparation and drip edge installation.

FIG. 2 is a top view of the roof deck 102 illustrating valley 104 preparation and drip edge 108 installation. In this step of the present methodology, the user installs peel and stick membrane 106 in the valleys 104 while overlapping membrane 106 seams a preferred minimum of six inches. The membrane 106 used is preferably a self-adhering poly(styrene-butadiene-styrene) (SBS) type. The membrane 106 used in the preferred embodiment was Tarco™ Leak Barrier Ice and Water Armor; however, any equivalent membrane can be utilized. The membrane 106 is preferably 36 inches wide. All drip edge 108 metals are then installed. The drip edge 108 is preferably D style No. 26 gauge galvanized or 16 ounce copper metal. On new construction, if the exterior fascia board has not been painted, the drip edge 108 may be delayed and installed after the underlayment 110 (See FIG. 3) is installed. The underlayment 110 (See FIG. 3) must extend over the drip edge 108 metal.

Figure 3:
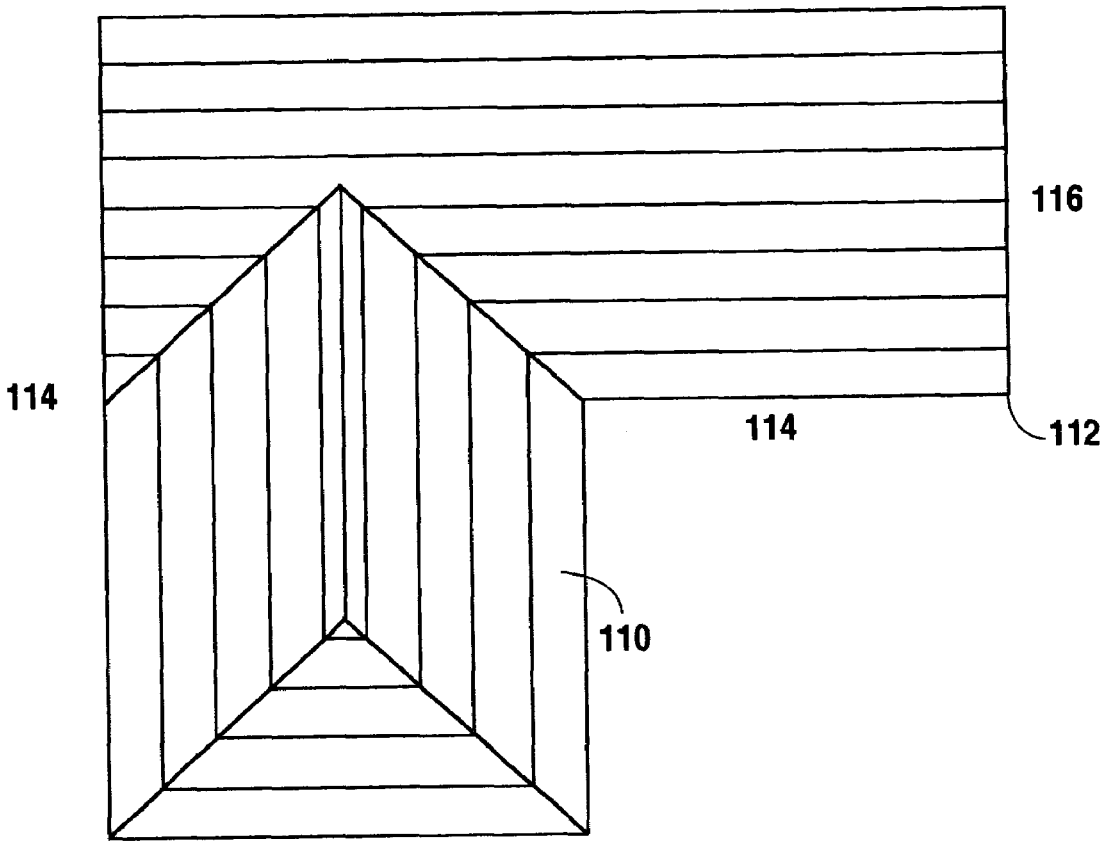
FIG. 3 is a top view of the roof deck illustrating placement of underlayment.

In FIG. 3 a top view of the roof deck 102 illustrating placement of underlayment 110 is shown. In this step of the present methodology, the user installs underlayment 110. The underlayment 110 is preferably a poly(styrene-butadiene-styrene) (SBS) multipurpose or Type 30 per ASTM D226. During this step, the user will roll the underlayment 110 over the gable/rake edge 112 a preferred minimum of one inch. There is a preferred minimum headlap of two inches for the underlayment 110; this is preferably increased to a minimum of four inches in wet or snow areas. Headlap for purposes of this application is defined as the portion of slate 130 (See FIG. 6) overlapped by two Layers of slate 130 (See FIG. 6) from the next two rows. Headlap makes the roof watertight. Failure to adhere to the recommended headlap can lead to interior water damage. There is a preferred minimum six inch sidelap for the underlayment 110. For purposes of this application, sidelap is defined as side edges of adjoining pieces of underlayment. Nails (not shown) are used to secure the underlayment 110 and have a pattern of preferably 12 inches on center at the headlap and preferably 36 inches on center at the center of the underlayment roll.

Figure 4:
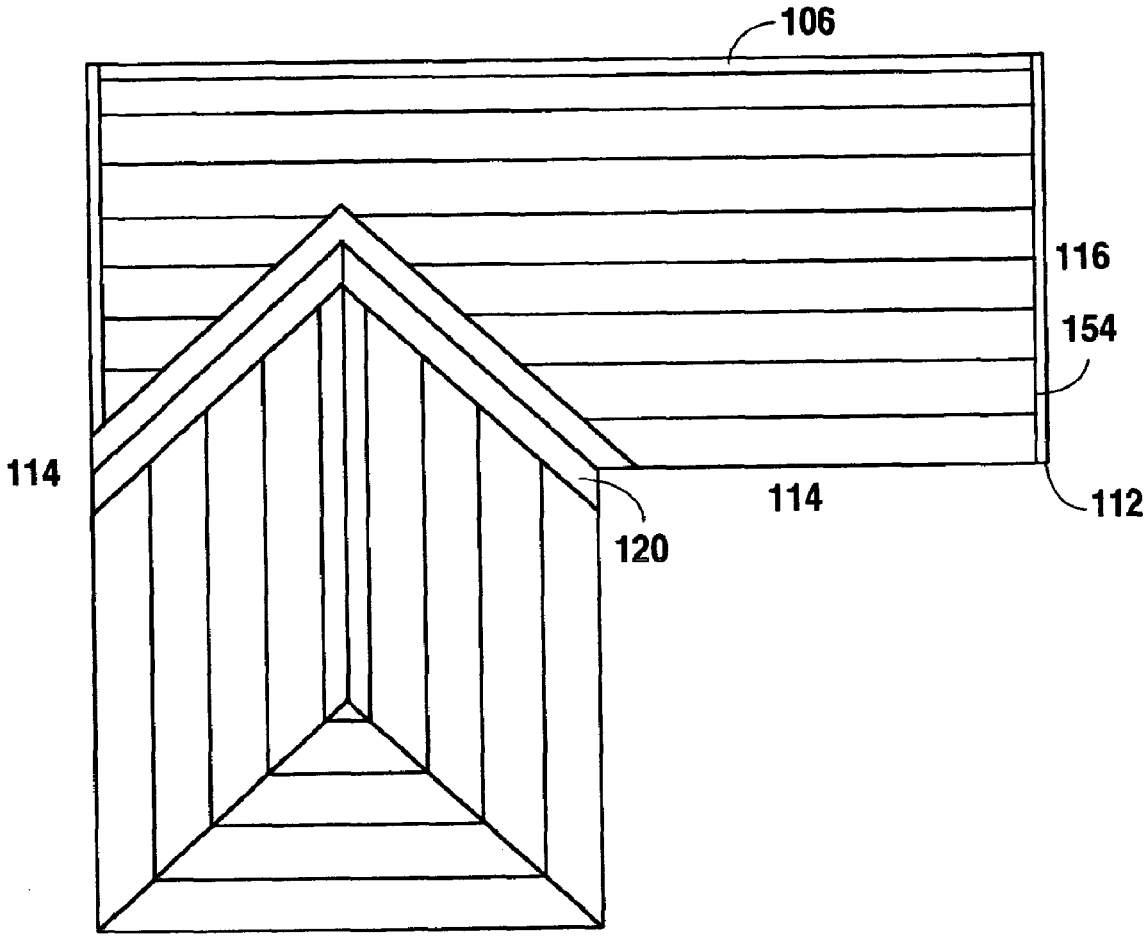
FIG. 4 is a top view of the roof deck illustrating placement of valley metals and rake edge metals.
Figure 16:
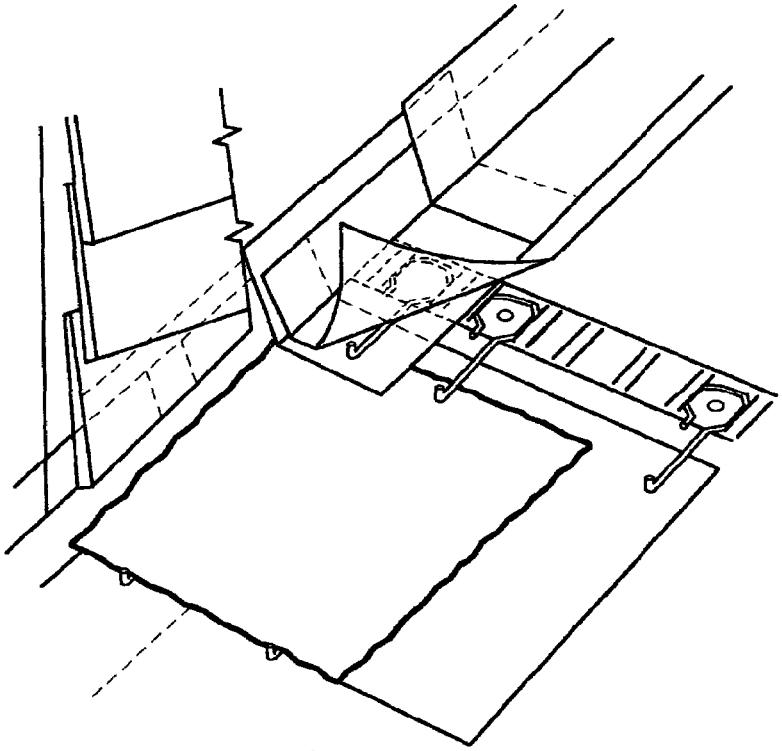
FIG. 16 is a perspective view of the roof deck illustrating flashing at siding.
Figure 17:
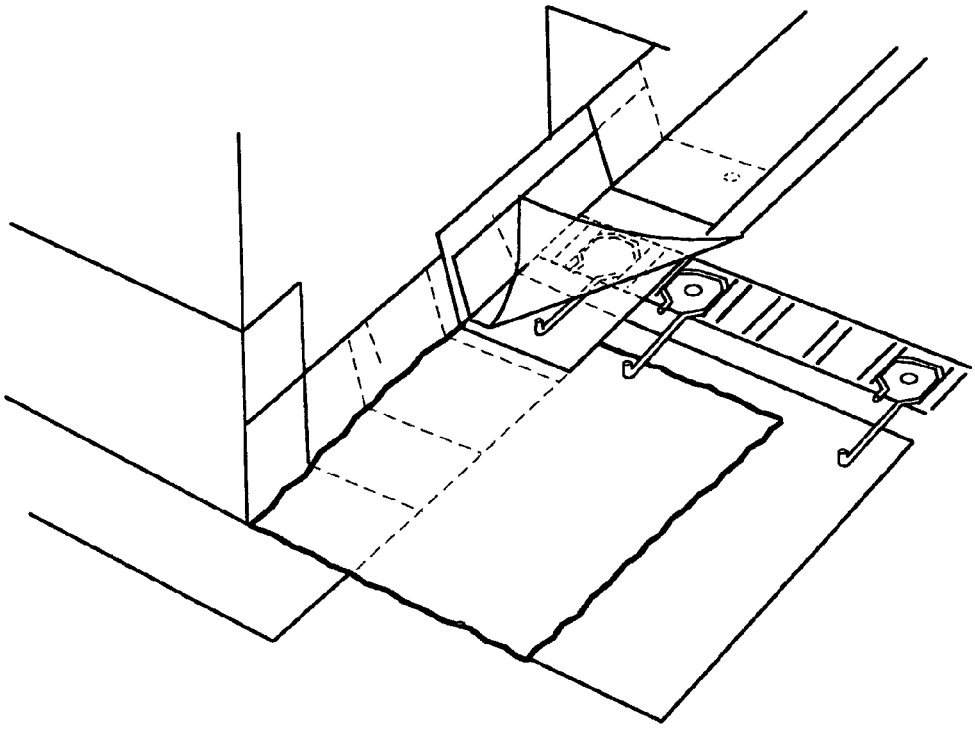
FIG. 17 is a perspective view of the roof deck illustrating flashing at sidewall/chimney.
Figure 18:
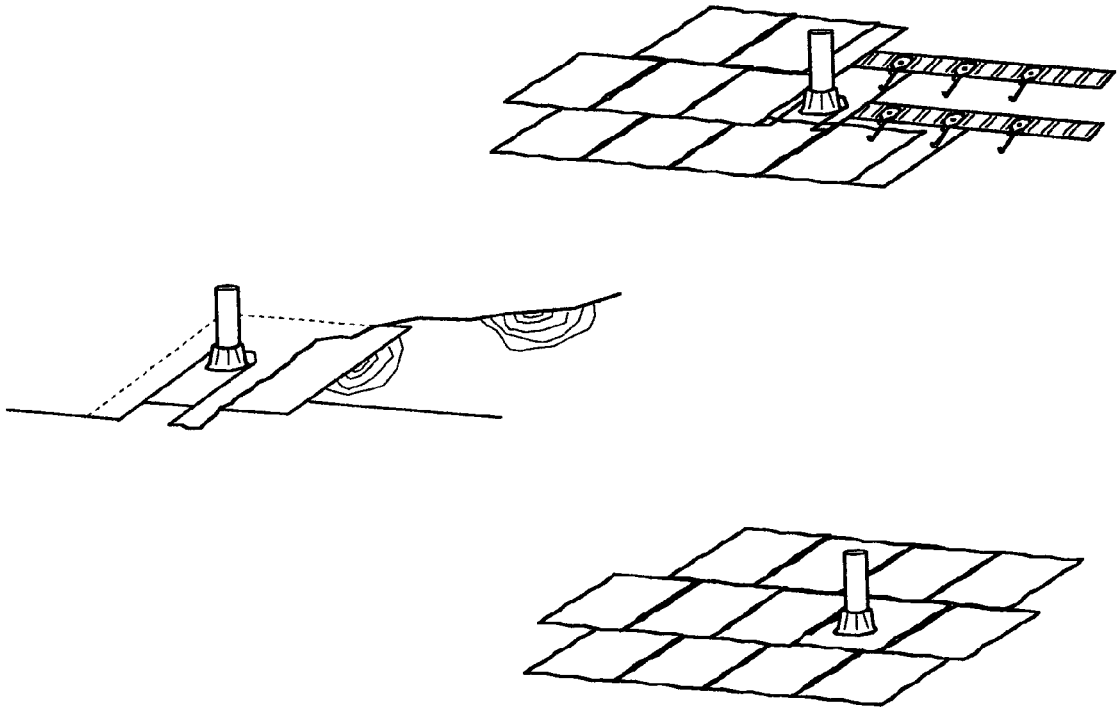
FIG. 18 is a perspective view of the roof deck illustrating plumbing vent details with installation.

FIG. 4 is a top view of the roof deck 102 illustrating placement of valley metals 120 and rake edge metals 154. In the present methodology, the user will install valley metal 120 over membrane 106 (See FIG. 2). This valley metal 120 is preferably 26 gauge galvanized, 24 inch "W", or 16 ounce copper metal. It is preferably installed with a one inch splash diverter (not shown) and preferably fastened with 1.25 inch roof nails or 1.25 inch copper slating nails one inch from the edge. The user will also install gable/rake edge metals 154 at gable/rake edge 112. The gable/rake edge metal 154 is preferably 26 gauge galvanized or 16 ounce copper metal. Next the user will install vertical wall flashings (See FIGS. 16 and 17) and plumbing stack and vent flashings (See FIG. 18). The vertical wall flashings (See FIGS. 16 and 17) are preferably 26 gauge galvanized or 16 ounce copper. At the next step, the user will install peel and stick membrane 106 over ridge 118. The membrane 106 used is preferably a self-adhering poly (styrene-butadiene-styrene) (SBS) type. The membrane 106 is preferably 12 inches wide having three inch endlaps.

Figure 5:
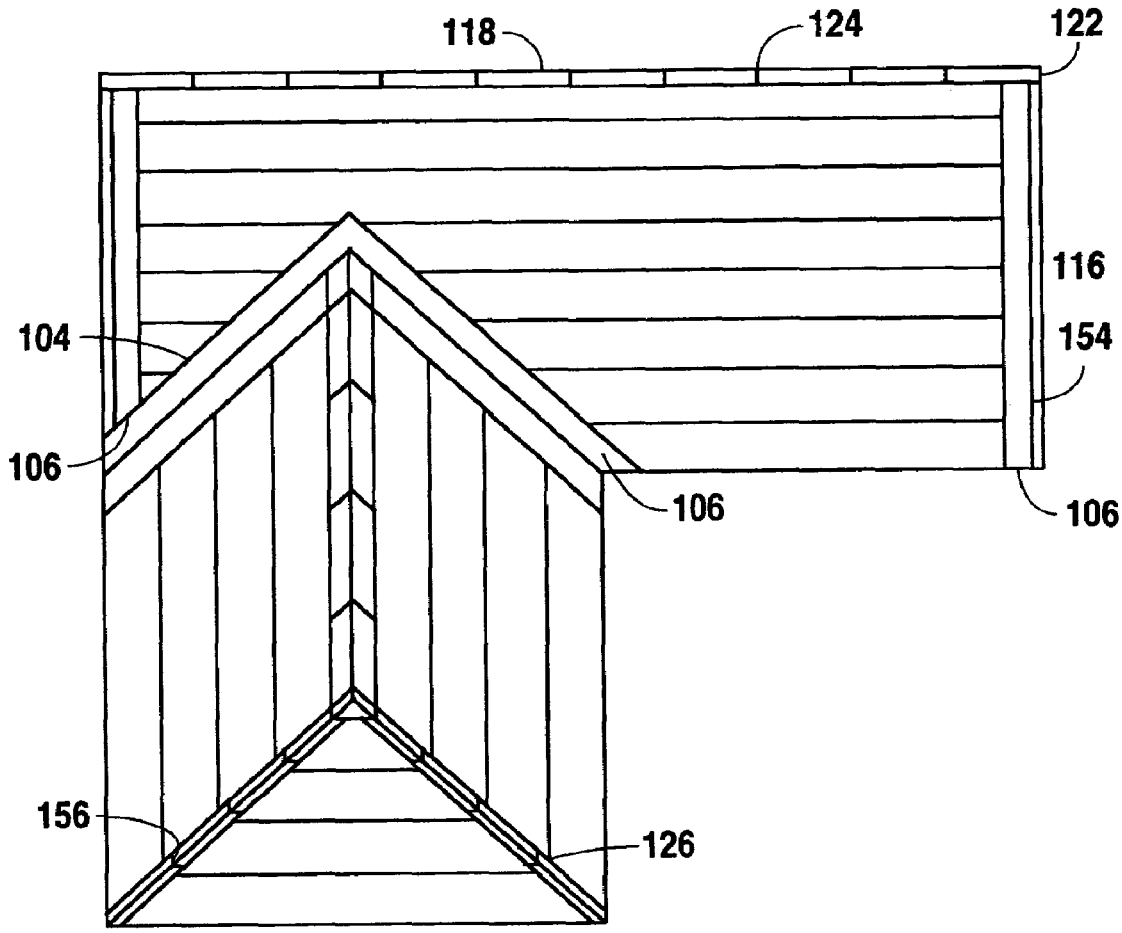
FIG. 5 is a top view of the roof deck illustrating preparation of all valleys, hips, ridges, walls and roof penetrations.

In FIG. 5 a top view of the roof deck 102 illustrating preparation of all valleys 104, hips 156, ridges 118, walls and roof penetrations is shown. Peel and stick membrane 106 is applied over valley metal 120 (See FIG. 4) leaving preferably three inches from the center line of valley 104 uncovered. The membrane 106 should cover valley metal 120 a preferred minimum of 11 inches on each side of the center line and cover nails a preferred minimum of three inches. With a utility knife, the user will cut preferably ten inch wide strips from the roll of peel and stick membrane 106. The user will install peel and stick membrane 106 over the gable/rake edge metal 154 being sure to cover all fasteners. The membrane 106 should extend a preferred minimum of six inches beyond the gable/rake edge metal 154 over the underlayment 110. This gable/rake edge metal 154 membrane 106 will also extend over the valley 104 membrane 106. The membrane 106 on the valley metal 120 and the gable/rake edge metal 154 is self-adhered, not nailed. The membrane 106 should also be installed over all other flashings and roof penetrations a preferred minimum of six inches past all flashings. Next the user will install the hip spacer 126 and the ridge spacer 122 using preferably 1.5 inch roofing nails or coated decking screws. These fasteners are preferably placed at 24 inches on center on each side of the nailer. Spacer flashing 124 is cut from slate liner 140 and placed over the ridge spacer 122 and should preferably overlap 12 inches at sidelaps.

Figure 6:
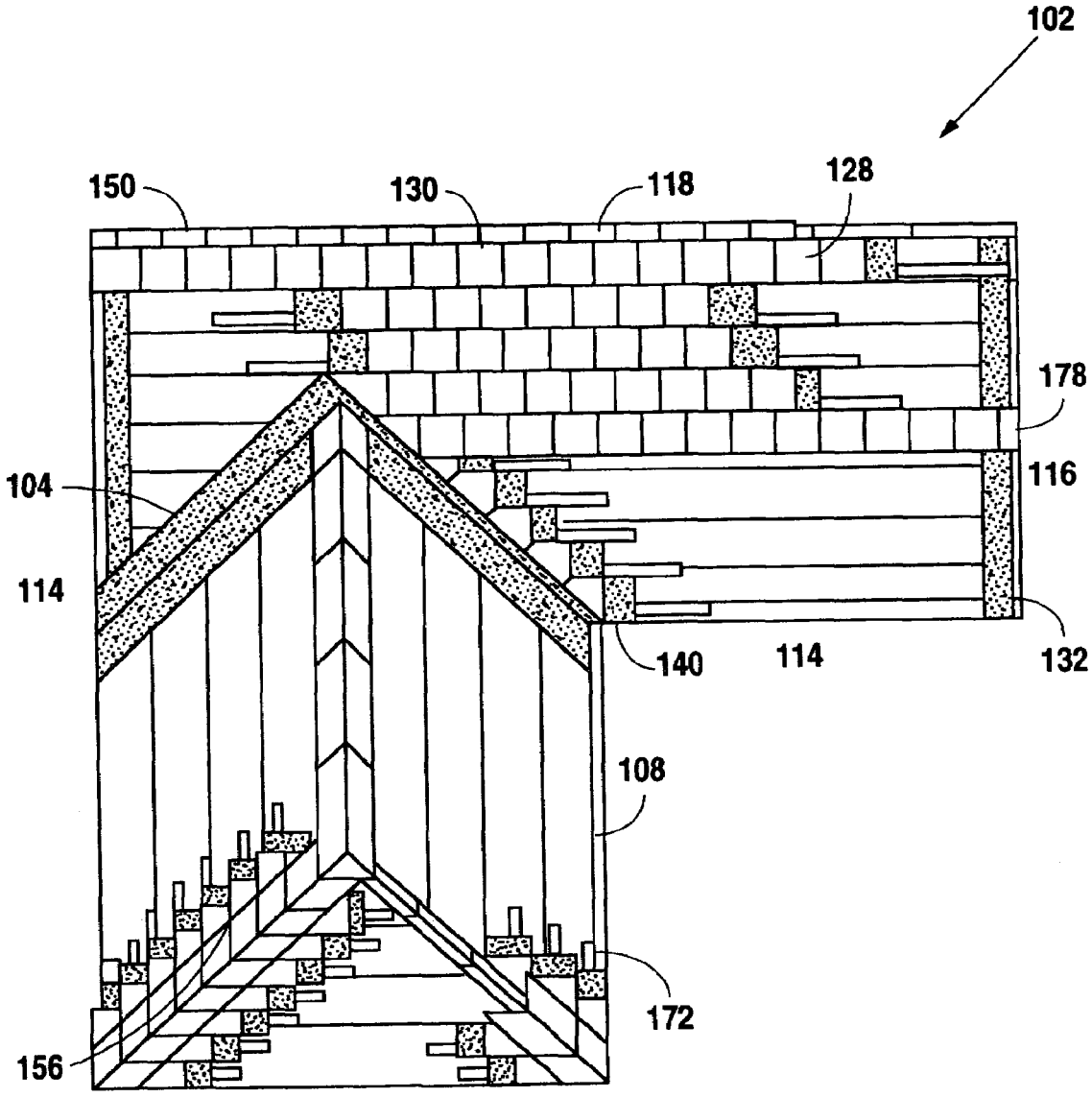
FIG. 6 is a top view of the roof deck illustrating the installation of slate.
Figure 7:
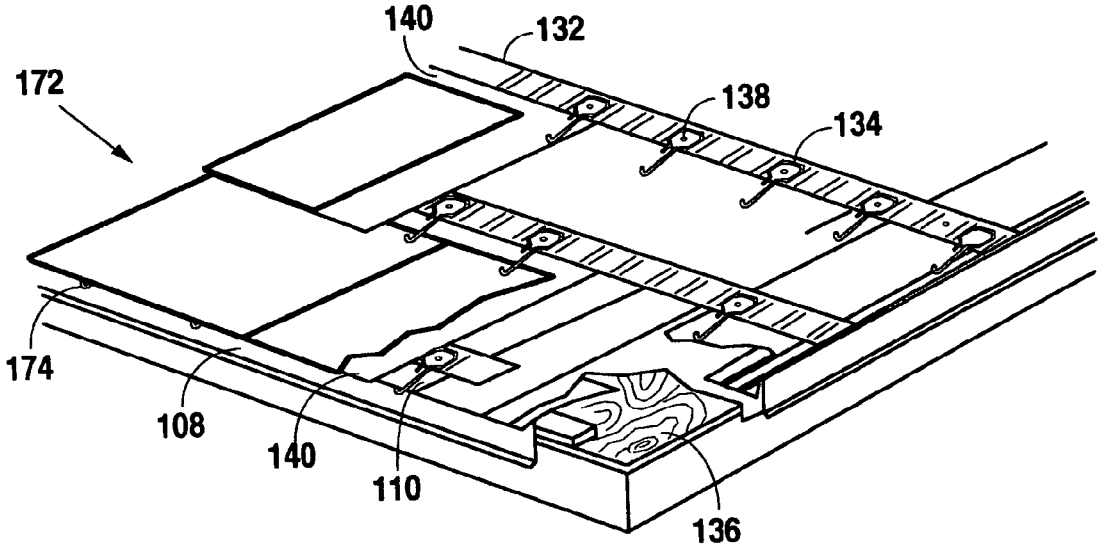
FIG. 7 is a perspective view of the roof deck illustrating installation of slate.
Figure 8:
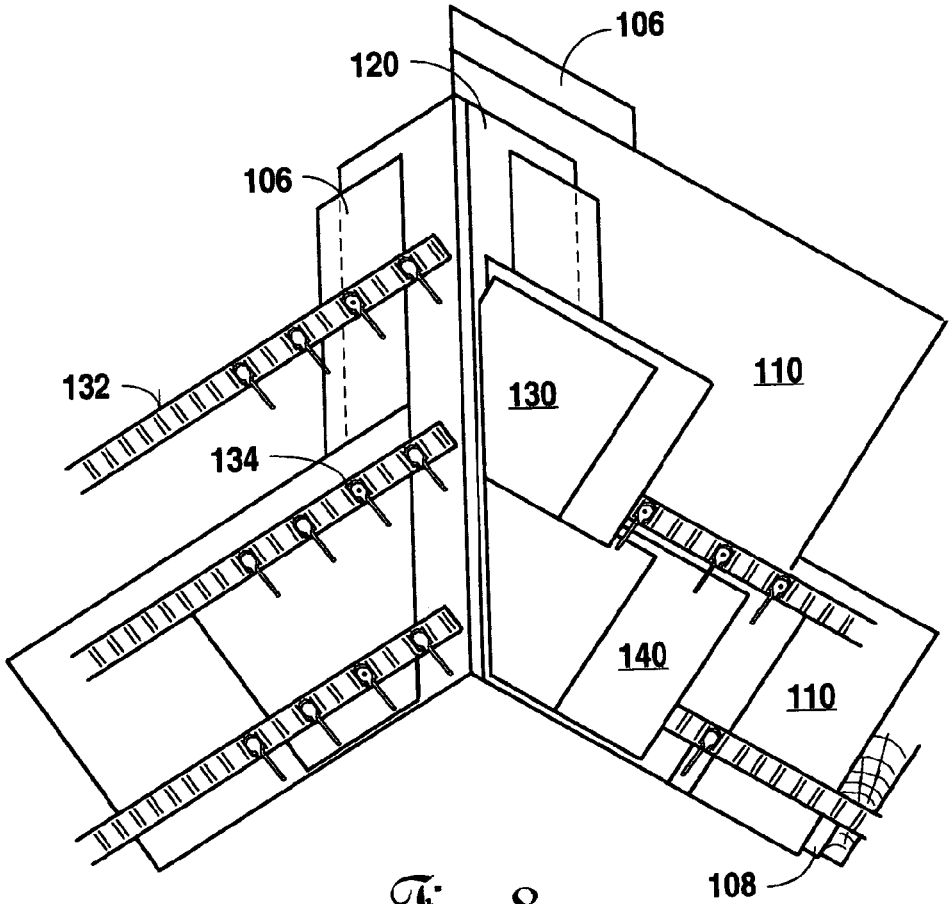
FIG. 8 is a perspective view of the roof deck illustrating slate installation at the valley.

FIG. 6 is a top view of the roof deck 102 illustrating the installation of slate 130. In the slate installation step, the roof deck 102 is outlined with slate 130. The hips 156, ridges 118 and valleys 104 are outlined first. Next the user wilt locate and mark the bottom batten row 172 at the drip edge 108. The bottom row 174 (See FIG. 7) of hangers 134 (See FIG. 7) should extend to the drip edge 108. The user will use a chalk line and measuring tape to locate the remaining rows for battens 132. Battens 132 should be preferably installed at 10 inch intervals. The battens 132 are preferably galvanized or stainless steel. Stainless steel is generally used where coastal salt water corrosion is a concern. Batten 132 spacing may be increased or decreased to accommodate fraction spacing. The user will begin at the hips 156 and valleys 104 and work up the roof deck 102 installing a full batten 132, slate liner 140, and 2-3 slates 130 at each row, leaving the field clear to walk. Next the user will locate and install top row battens 132, slate liner 140, and top row of slates 130 (ridge row 178), then install ridge slates 150. The ridge slates 150 should overlap and lock in the ridge row 178 of slates 130. The user will trim off any exposed slate liner 140 with a utility knife. Beginning four rows down from the ridge row 178 of states 130, the user will install batten 132 on one complete row of slate 130. Hangers 134 are preferably preinstalled on battens 132. The user will lay slate liner 140 on hangers 134 (See FIG. 7) and drop slate 130 onto hangers 134 (See FIG. 7). The hangers 134 (See FIG. 7) are preferably spring tempered stainless steel. The user is cautioned to confirm that the keyways or joints line up with the ridge row 178 of slate 130. Next the user will install the next row of battens 132 locking in the row of slate 130 below and repeating the process. The user offsets the keyways ½ slate 130 every other row. The last row may be "shoe-horned" in by the user. The user will come down the roof four rows and repeat the process. A perspective view of this slate installation process is shown in FIG. 7 white FIG. 8 illustrates a perspective view of the slate installation at the valley 104. Greater detail on the slate 130 installation is show in FIGS. 12-15.

Figure 9:
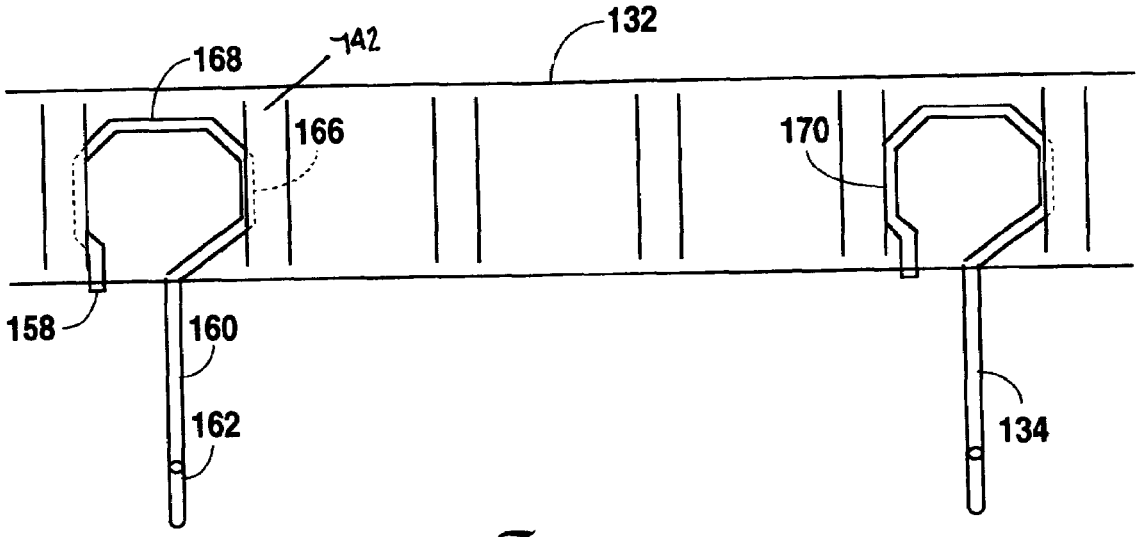
FIG. 9 is a top view of batten with hangers used in the present methodology.
Figure 19:
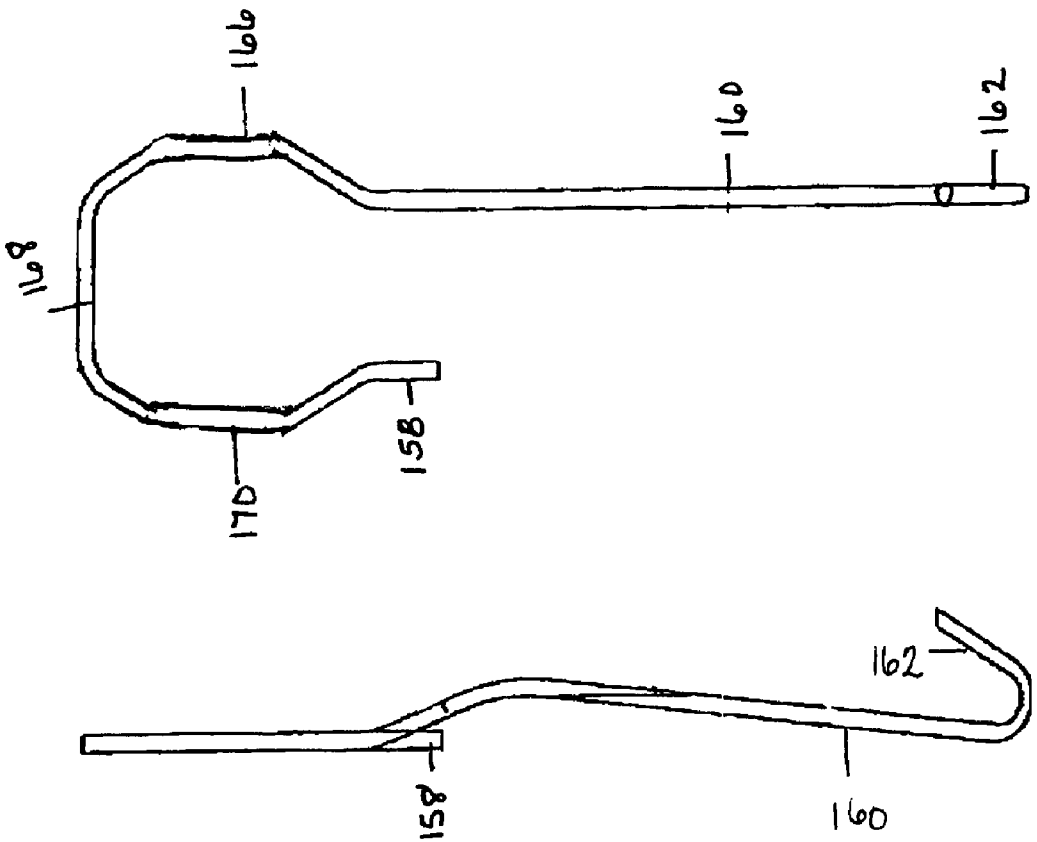
FIG. 19 is a side view of the hanger of the present invention.

In FIG. 9 a top view of batten 132 with hangers 134 used in the present methodology is shown. Hangers 134, which are preferably spring tempered stainless steel, can be easily installed and removed to facilitate proper support for the slate 130. The hangers 134 represent the strength of the present invention and provide a convenient way to quickly and easily install and remove individual slate 130. The hangers 134 have a short member 158 and a long member 160. The long member 160 has an upward facing hook 162 at one end and the remaining end is adjacent to a first outward extending arm 166. The first outward extending arm 166 is adjacent a central connecting member 168. This central connecting member 168 is adjacent a second outward extending arm 170. This second outward extending arm 170 is adjacent the short member 158. While the majority of hanger 134 rests in one plane, long member 160 extends at an angle above the plane of first outward extending arm 166, curves downward at an angle and ends at a point within the linear plane of the first outward extending arm 166. This is illustrated in more detail in FIG. 19. When installing the hanger 134, the user will insert the second outward extending arm 170 of the hanger 134 into an opening formed by a first hanger holder 142. The first outward extending arm 166 of hanger 134 will then be inserted into an opening formed by an adjacent hanger holder 142. When removing the hanger 134, the user squeezes together the short member 158 and Long member 160 to remove the hanger 134 from the first hanger holder 142 and the adjacent hanger holder 142.

Figure 10:
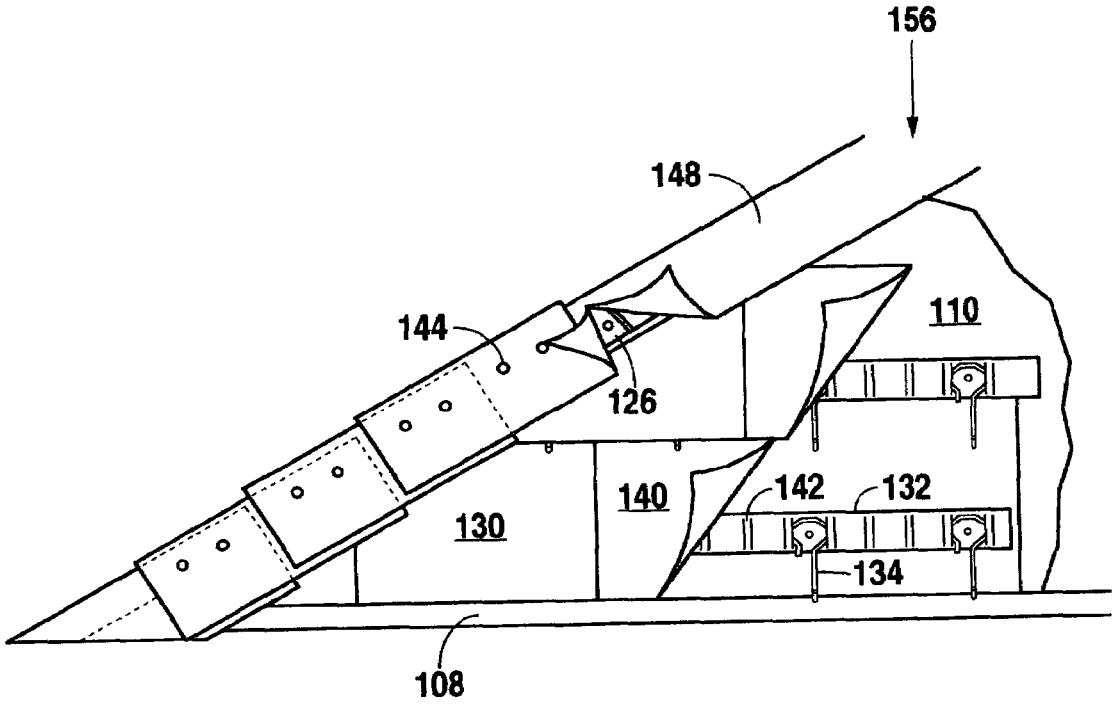
FIG. 10 is a front view of the roof deck illustrating hip installation of slate.

FIG. 10 is a front view of the roof deck 102 illustrating hip 156 installation of state 130. The hips 156 of the roof deck 102 are one of the first areas outlined with state 130. The user will install battens 132 on top of the underlayment 110. Hangers 134 are inserted into hanger holders 142 of battens 132. The user will lay slate liner 140 on hangers 134 and drop slate 130 onto hangers 134. At the hips 156, hip spacer 126 is applied followed by hip spacer cover 148. Slate trim pieces 146 are applied and attached to hip 156 by decking screws 144.

Figure 11:
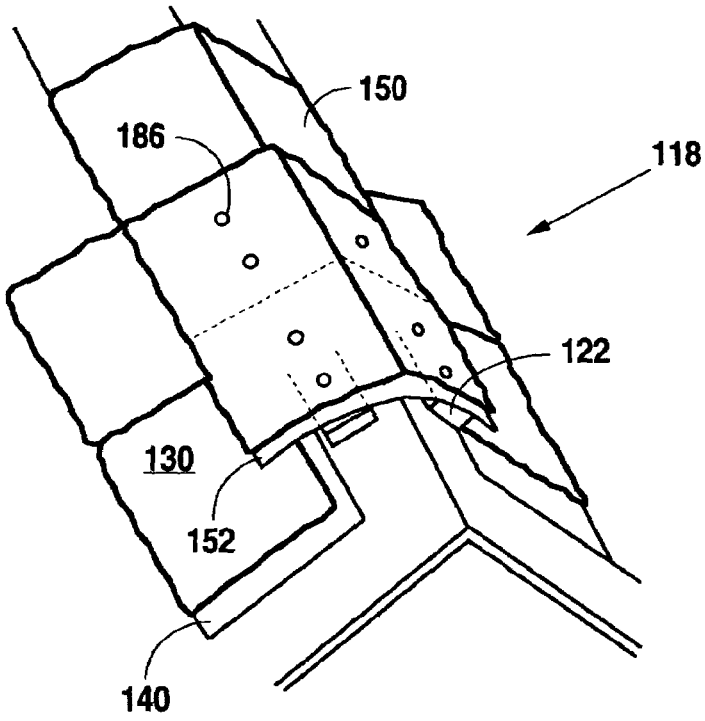
FIG. 11 is a top view of the roof deck illustrating the ridge.
Figure 12:
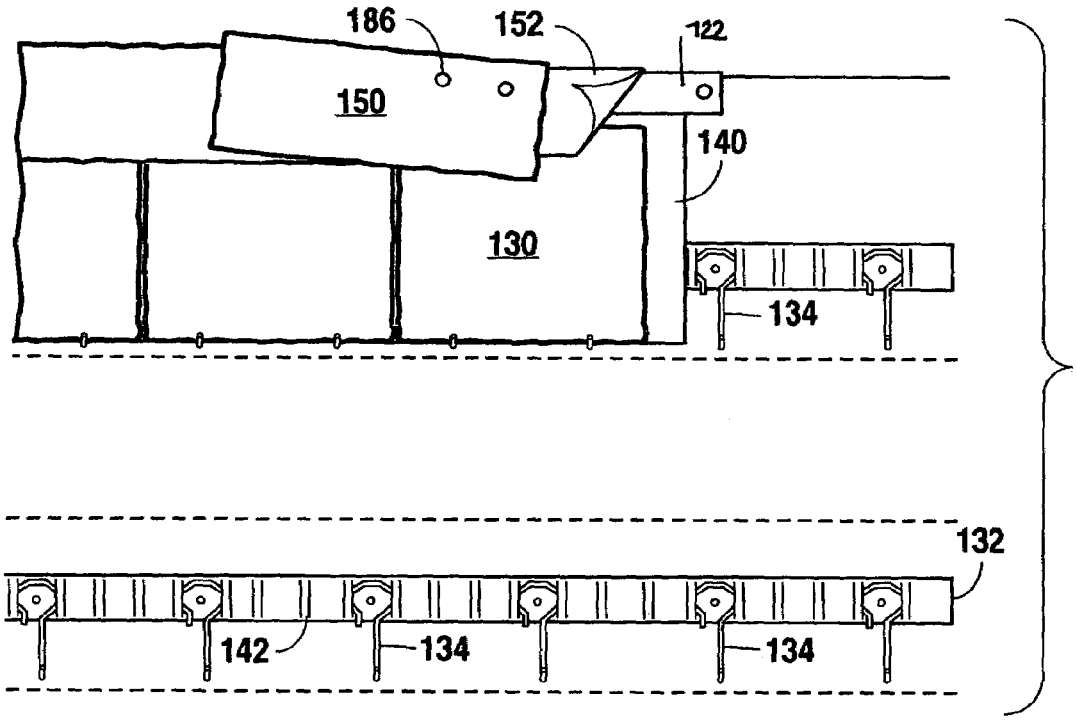
FIG. 12 is a side view of the roof deck illustrating ridge installation of slate.

In FIG. 11 a top view of the roof deck 102 illustrating the ridge 118 installation is shown. With the ridge 118 installation step, the user will install ridge spacers 122 by making sure the ridge spacer 122 is preferably evenly spaced over the ridge 118 and fastened at preferably 24 inches on center along each side of ridge 118 with preferably 1.5 inch roofing nails or screws. The user will place preferably 13 inch wide slate liner 140 over the ridge spacers 122 so that the center line of slate liner 140 is centered along the ridge 118. It is preferred to work with 10-12 foot lengths being sure to preferably overlap end joints 12 inches minimum. Next, the user installs top batten 132 (See FIG. 12) along a chalk line using a nail gun and preferably 1.25 inch 0.120 galvanized standard coil fed roofing nails. Hangers 134 (See FIG. 12) are inserted into hanger holder 142 (See FIG. 12) of battens 132 (See FIG. 12). The batten 132 (See FIG. 12) is fastened at the center of the hanger 134 (See FIG. 12) except at the gable/rake edges 112 (See FIG. 4). The user lays the slate liner 140 along row of hangers 134 (See FIG. 12) and tucks under the plastic ridge spacer cover 152. The ridge spacer cover 152 should preferably overlap top row of slate liner 140 by a minimum of three inches. The user will next lay the first row of slate 130 by placing bottom edge of each slate 130 into top row of hangers 134 (See FIG. 12). The hangers 134 (See FIG. 12) are preferably preinstalled at six inches center. The slates 130 are preferably twelve inches wide by twelve inches long standard quarried slate. The user must be careful that the hangers 134 (See FIG. 12) are evenly spaced on the slate 130. Each hanger 134 (See FIG. 12) should be preferably three inches from the edge of each full piece of slate 130. On smaller pieces, care should be taken to be sure two hangers 134 (See FIG. 12) are supporting each piece of slate 130. Hanger 134 (See FIG. 12) can be easily removed and replaced to facilitate spacing up to preferably 1.5 inches. The user must never install a piece of slate less than four inches in width. If a measurement calls for a piece of slate 130 less than four inches wide, the adjacent piece should be cut back so that the small piece is preferably a minimum of four inches. The cut edges can be placed side by side so that the cut edge disappears and is not distinguishable. The user must be sure the ridge spacer cover 152 overlaps the top row of slate 130 a preferred minimum of two inches. The top edge of the top row of slate 130 should be no more than preferably one inch from the bottom of the ridge spacer 122. The ridge trim pieces 150 are installed by nailing or screwing each piece of state 130 through two predrilled holes 186 directly through the ridge spacer 122 into the roof deck 102. The trim pieces 150 are preferably 16 inch.times.7 inch standard quarried slate predrilled. The edge of each trim piece 150 must meet at the top of the ridge 118 and one piece should slightly overlap the other so that a clean, weather resistant joint is formed. If desired, the user may apply a weatherproof caulk of a matching color to the joint. The caulk is preferably a high quality exterior grade silicone. Next, the next ridge trim piece 150 is installed by overlapping the previously installed piece by preferably six inches. If desired, each nail hole can be covered with a weatherproof caulk. The ridge trim pieces 150 should overlap the top of the first row of state 130 by a preferred minimum of two inches. Care should be taken not to overdrive the fasteners on ridge trim pieces 150. The slates 130 should be able to wiggle slightly. Any plastic ridge spacer cover 152 that is visible after the ridge trim pieces 150 are installed can be carefully trimmed with a utility knife. FIG. 12 is a side view of the roof deck 102 illustrating ridge 118 installation of slate 130.

Figure 13:
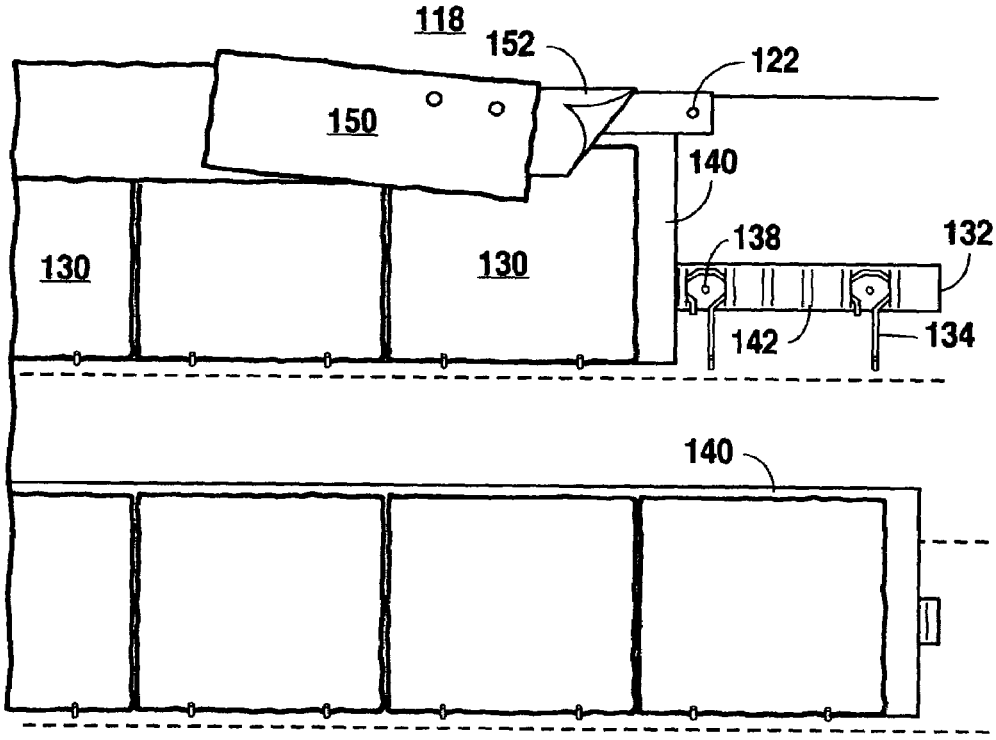
FIG. 13 is a detailed view of slate installation step 1.

In FIG. 13 a detailed view of slate 130 installation step 1 is shown. In installation step 1, the user installs battens 132 end to end on a fourth chalk line from the top or ridge 118. The user fastens each batten 132 with roofing nails 138 at the center of each hanger 134 approximately every six inches. The slate liner 140 is next installed by placing it along the row of battens 132 using the hangers 134 to support the slate liner 140. It is recommended that each piece of slate liner 140 be preferably a maximum of 25 feet long. The pieces of slate liner 140 should preferably overlap a minimum of twelve inches at side laps. Slate liner 140 should be installed with the dull finish side up or shiny side down. No nails are driven through the slate liner 140. Next the user installs slates 130 by placing slates 130 on the hangers 134 being careful to keep hangers 134 centered on the slates 130. Each slate 130 should have two hangers 134 supporting it preferably evenly spaced from each side edge of the slate 130. Full states 130 should have a hanger 134 preferably three inches from each side edge. At the beginning or end of each row a one-half slate offset is recommended and can be achieved by placing additional hangers 134 at the hanger holders 142 provided in the battens 132. The battens 132 can be cut with tin snips. The user should align the battens 132 end to end preferably maintaining a six inch space between the hangers 134 for slates 130 (or three empty hanger holders 142 in the battens 132). Battens 132 should be held back ½ inch from ridge spacers 122 or gable/rake edge metals 154 (See FIG. 5).

Figure 14:
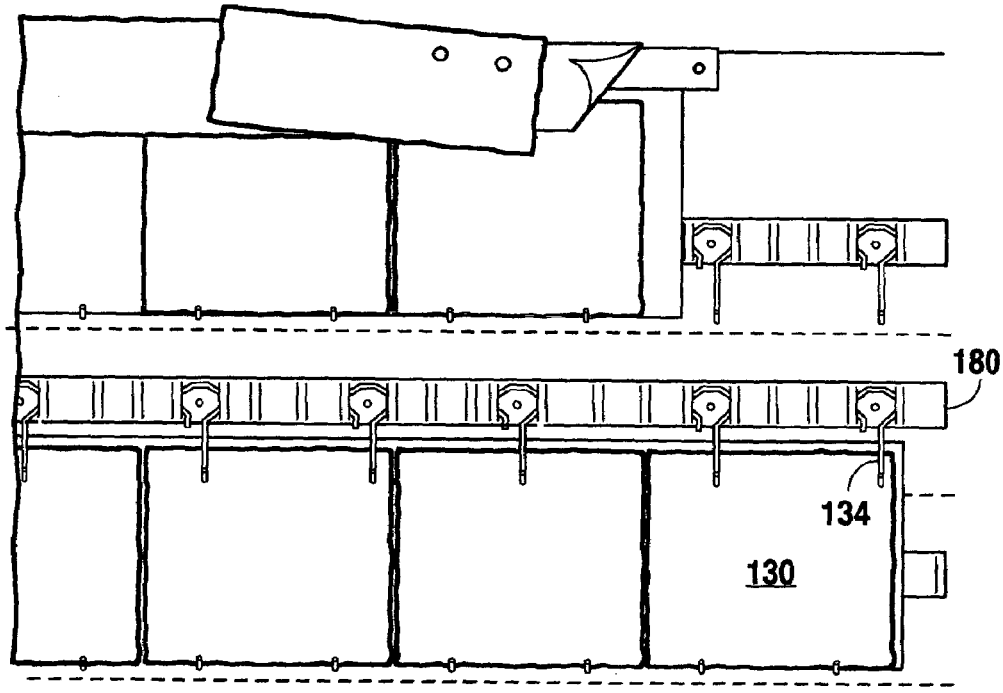
FIG. 14 is a detailed view of state installation step 2.

FIG. 14 is a detailed view of slate 130 installation step 2. In this step of installation, the user will install the next row 180 of battens 132. The battens 132 should lock into the slates 130 below. The user must be sure the hangers 134 are preferably evenly spaced on the states 130 below. The hangers 134 should be preferably three inches from each edge of each slate 130. Tin snips are used to trim the battens 132 at the ends to facilitate hanger 134 spacing.

Figure 15:
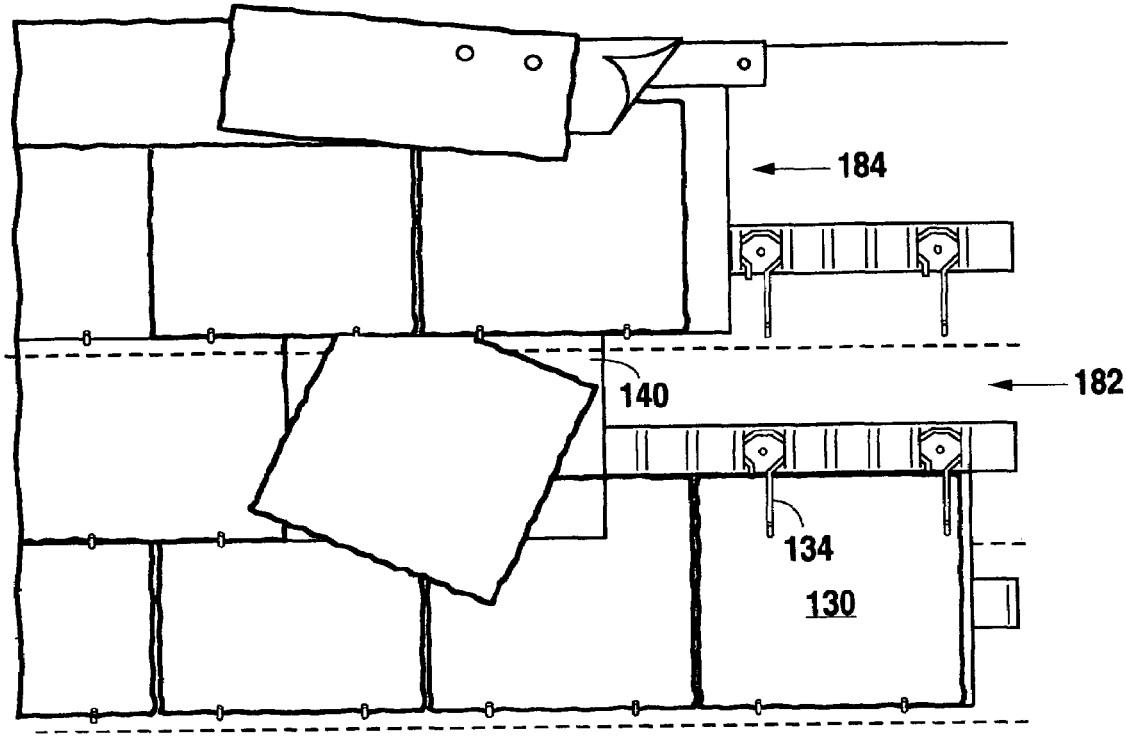
FIG. 15 is a detailed view of state installation step 3.

In FIG. 15 a detailed view of slate 130 installation step 3 is shown. In this step of installation, at the top row of each working section an open row 182 is created. To complete the installation of the open row 182, the user must install slate liner 140 by slipping it under the top row 184 of slate 130. The bottom edge of the slate liner 140 is held in place by hangers 134. Next the user installs the slates 130 by slipping the top edge of the slate 130 under the top row 184 until the bottom edge of the slate 130 clears the hangers 134 below. The user pulls or pushes the slate 130 downward slightly until the hangers 134 support the bottom edge of the slate 130. Preferably an 18 inch wide piece of slate liner 140 can be used as a shoehorn by inserting it first, then the slate 130 slides easier into place. The shoehorn is removed and the process is repeated.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

What is claimed is:

1. A system for supporting roofing members on a roof structure, the system comprising:

at least one batten having a plurality of hanger holders disposed along its length, each hanger holder comprising opposing openings formed through the at least one batten; and a plurality of hanger devices removably secured to the batten by opposing outward extending arms expanding within the opposing openings, the hanger devices operable to support roofing members; wherein the roofing members are slate members; and each slate member has a top edge and a bottom edge; and the bottom edge of each of the slate members is supported by one or more of said hanger devices; wherein a bottom portion of each of the hanger devices extends away from the roof to support the bottom edge of one of the slate members, and a top portion of each of the hanger devices securely engages the at least one batten.

2. A system according to claim 1, wherein the plurality of hanger holders comprise opposing raised openings for receiving the hanger devices.

3. A system according to claim 1, wherein the hanger devices are spring tempered.

4. A system according to claim 3, further comprising one or more slate liners, wherein each slate liner is positioned atop the hanger devices associated with a row of slate members, underlying the slate members of the row.

5. A system according to claim 4, wherein a bottom portion of each of the hanger devices extends away from the roof to support the bottom edge of one of the slate members and the slate liner, a top portion of each of the hanger devices securely engages the at least one batten, and a bottom edge of the slate liner is coincident with the bottom edge of the slate members.

6. A system according to claim 5, further comprising an underlayment positioned on the roof structure below the battens.

7. A system according to claim 5, further comprising a plurality of battens for accommodating a plurality of rows of slate members, wherein the slate members are operatively secured to the roof structure in overlapping rows, wherein the bottom portion of each of the hanger devices of one of the rows extends downward to partially overlap the slate members of the row immediately below.

8. A system device as in claim 7, wherein the slate liner of one of the rows completely underlies the slate members of the row, and wherein the upper edge of the slate liner extends up beyond the top edge of the slate members of the row.

9. A system for attaching slate members to a roof, the system comprising:

at least one batten, the batten having a plurality of hanger holders disposed along its length, each hanger holder comprising opposing openings formed through the at least one batten; and a plurality of hangers removably secured to the at least one batten via the plurality of hanger holders, the hangers being spring tempered to permit positioning of the hangers along the length of the battens by opposing outward extending arms of the hangers expanding within the opposing openings; wherein each slate member has a top edge and a bottom edge, and wherein the bottom edge of each of the slate members is supported by one or more of said hangers; wherein a bottom portion of each of said hangers extends away from the roof to support the bottom edge of one of the slate members.

10. A system according to claim 9, wherein the expanding force of the opposing outward extending arms is sufficient for the hangers to resist lifting forces when attached to the at least one batten.

11. A system according to claim 10, further comprising one or more slate liners, wherein each of said slate liner is positioned atop the hangers associated with a row of said slate members, underlying the slate members of the row.

12. A system according to claim 11, wherein the slate liner and a top portion of each of said hangers securely engages the at least one batten, and the bottom edge of the slate liner is coincident with the bottom edge of the slate members.

13. A system according to claim 12, further comprising a plurality of battens for accommodating a plurality of rows of said slate members, wherein the slate members are attached to the roof in overlapping rows, wherein the bottom portion of each said hanger of one of the rows extends downward to partially overlap the slate members of the row immediately below.

14. A system according to claim 13, wherein the slate liner of one of the rows completely underlies the slate members of the row, and wherein the upper edge of the slate liner extends up beyond the top edge of the slate members of the row.

15. A method for disposing roofing members on a roof structure, comprising:

disposing a plurality of battens along a roof structure, the battens having a plurality of hanger holders associated therewith and disposed along its length, each hanger holder comprising opposing openings formed through the at least one batten;

providing a plurality of hangers each comprising opposing outward extending arms connected by a central member;

compressing a portion of each hanger to force outward extending arms towards each other; and disposing the outward extending arms into a pair of corresponding openings defined by the hanger holders, the hangers secured to the batten by opposing outward extending arms expanding within the opposing openings; wherein the hangers each comprise a lower hook portion, and wherein the method further comprises disposing liners atop the hangers such that a bottom edge of the liners abuts the hook portion of the hangers; disposing roofing members atop the liners such that a bottom edge of the roofing members abuts the hook portion of corresponding said hangers.

16. A method according to claim 15, further comprising compressing the portion of at least one of said hanger and removing the hanger from the corresponding pair of openings defined by the hanger holders.

17. A method according to claim 16, further comprising moving the hanger to another location along the batten, compressing the portion of the hanger and disposing the outward extending arms into another of a pair of corresponding openings defined by the hanger holders.

* * * * *